US010450869B2

(12) United States Patent
Brignole et al.

(10) Patent No.: US 10,450,869 B2
(45) Date of Patent: Oct. 22, 2019

(54) GAS TURBINE COMPRESSOR

(71) Applicant: MTU Aero Engines AG, Munich (DE)

(72) Inventors: Giovanni Brignole, Munich (DE); Tobias Mayenberger, Munich (DE)

(73) Assignee: MTU Aero Engines AG, Munich (DE)

( * ) Notice: Subject to any disclaimer, the term of this patent is extended or adjusted under 35 U.S.C. 154(b) by 352 days.

(21) Appl. No.: 14/672,959

(22) Filed: Mar. 30, 2015

(65) Prior Publication Data

US 2015/0285079 A1 Oct. 8, 2015

(30) Foreign Application Priority Data

Apr. 3, 2014 (EP) ..... 14163465

(51) Int. Cl.

| | |
|---|---|
| ***F01D 5/14*** | (2006.01) |
| ***F01D 11/08*** | (2006.01) |
| ***F04D 29/32*** | (2006.01) |
| ***F04D 29/52*** | (2006.01) |
| ***F04D 29/68*** | (2006.01) |

(52) U.S. Cl.

CPC ..... *F01D 5/143* (2013.01); *F01D 11/08* (2013.01); *F05D 2220/32* (2013.01); *F05D 2240/12* (2013.01); *F05D 2240/30* (2013.01)

(58) Field of Classification Search

CPC ..... F01D 5/143; F01D 11/08; F01D 25/24; F04D 29/526; F04D 29/685; F04D 29/321

See application file for complete search history.

(56) References Cited

U.S. PATENT DOCUMENTS

| | | | | |
|---|---|---|---|---|
| 6,290,458 | B1 | 9/2001 | Irie et al. | |
| 6,935,833 | B2 * | 8/2005 | Seitz | F01D 5/145 415/58.1 |
| 7,186,072 | B2 * | 3/2007 | Seitz | F01D 5/145 415/57.1 |
| 8,257,022 | B2 * | 9/2012 | Guemmer | F04D 29/526 415/144 |
| 8,915,699 | B2 * | 12/2014 | Brignole | F04D 29/526 415/58.5 |
| 2004/0156714 | A1 | 8/2004 | Seitz | |
| 2005/0019152 | A1 | 1/2005 | Seitz | |
| 2010/0014956 | A1 | 1/2010 | Guemmer | |

FOREIGN PATENT DOCUMENTS

| | | |
|---|---|---|
| FR | 2989743 | 10/2013 |
| GB | 2408546 | 6/2005 |
| WO | WO 03072910 | 9/2003 |
| WO | WO 2004018844 | 3/2004 |

* cited by examiner

*Primary Examiner* — Brian P Wolcott
(74) *Attorney, Agent, or Firm* — Davidson, Davidson & Kappel, LLC

(57) ABSTRACT

A gas turbine compressor having at least one airfoil tip (10) and a flow duct wall (20) which is disposed radially opposite thereto and has a circumferential groove (31-33) therein in which is disposed at least one web (40) having a radial cutback (44) is provided. An upstream beginning (41) of the cutback is located axially downstream of an upstream groove edge (21) between this groove edge and an upstream leading edge (11) of the airfoil tip, and a downstream end (42) of the cutback is located in an airfoil-tip-proximal half (34) of a radial height (35) of the circumferential groove.

20 Claims, 2 Drawing Sheets

GAS TURBINE COMPRESSOR

This claims the benefit of European patent application EP14163465.9, filed on Apr. 3, 2014 and hereby incorporated by reference herein.

The present invention relates to a gas turbine compressor and an aircraft engine having such a gas turbine compressor, and to a method for designing such a gas turbine compressor.

BACKGROUND

A gas turbine compressor having a casing treatment (CT) is known from U.S. 2010/0014956 A1. The casing treatment includes a continuous or interrupted circumferential groove which is axially disposed in the region of a rotating airfoil tip and has deflecting means in the form of webs. In various exemplary embodiments, the webs have arbitrary radial cutbacks.

SUMMARY OF THE INVENTION

It is an object of an embodiment of the present invention to improve a gas turbine compressor.

It is an object of the present invention to provide a gas turbine compressor, in particular an axial gas turbine compressor including one or more airfoils arranged circumferentially adjacent one another and having tips, in particular shroudless tips, and further including a flow duct wall disposed radially opposite to the airfoil tips.

In one embodiment, the gas turbine compressor is a gas turbine compressor for, or of, an aircraft engine, and may in particular be a low-pressure compressor disposed upstream of another gas turbine compressor or a high-pressure compressor disposed downstream of another gas turbine compressor. In one embodiment, the airfoils are rotor blades which are arranged on a rotatably mounted rotor and rotate during operation, and the flow duct wall, which is fixed relative to the casing, is located radially outwardly of and opposite to the radially outer airfoil tips. In another embodiment, the airfoils are stator vanes which are fixed relative to the casing, and the rotatably mounted flow duct wall is located radially inwardly thereof and opposite thereto and rotates during operation.

The flow duct wall has a circumferential groove therein. In an embodiment, this circumferential groove has an upstream flank which merges into the flow duct wall at an upstream groove edge, a downstream flank which merges into the flow duct wall at a downstream groove edge, and a groove base connecting these groove flanks. In one embodiment, a groove edge may be sharp, i.e., angled, or rounded, i.e., have a radius. In the latter case, for dimensional specifications, the groove edge may be defined by the center point of its radius or the point of intersection of its two outermost tangents.

In one embodiment, the upstream groove flank and/or the downstream groove flank has/have an axial undercut. In a refinement, the cross-sectional area of the axial undercut in a meridional section is less than 10% of a cross-sectional area of the circumferential groove between its upstream and downstream groove edges.

In the context of the present invention, a meridional section is a plane section containing the axis of rotation of the compressor. An axial undercut of the upstream groove flank is a region of this groove flank that is located axially upstream of the upstream groove edge. Correspondingly, an axial undercut of the downstream groove flank is a region of this groove flank that is located axially downstream of the downstream groove edge. A cross-sectional area of the circumferential groove between its upstream and downstream groove edges is accordingly the area which, in a meridional section, is defined by the groove base, a straight connecting line between the upstream and downstream groove edges, and perpendicular lines through the upstream and downstream groove edges.

In one embodiment, the circumferential groove extends in particular continuously or uninterruptedly through the full circumference of the flow duct wall; i.e., through 360°. In other words, in one embodiment, each of the upstream and downstream groove edges is a continuous edge extending uninterruptedly through 360°. In one embodiment, the production and/or the aerodynamics of the circumferential groove can thereby be improved. The circumferential groove has one or more webs arranged therein. In one embodiment, a plurality of adjacent webs, in particular all webs, may be configured identically, and in particular have at least substantially identical dimensions and contours. In one embodiment, the production and/or the aerodynamics of the circumferential groove can thereby be improved. In one embodiment, adjacent webs may also be configured differently, and in particular have different dimensions and/or contours. In one embodiment, this makes it possible to deliberately produce or compensate for asymmetries. Three or more webs, in particular all webs, may be equidistantly spaced in the circumferential direction. Likewise, three or more webs, in particular all webs, may have pairwise different spacings in the circumferential direction.

One or more webs, preferably all webs, have a radial cutback. As used herein, a "radial cutback" is understood to be in particular an empty space between an airfoil-side end face of the web and its projection into a reference plane extending from the upstream groove edge to the downstream groove edge, the curvature of the reference plane in the meridional sections through the end face being infinite or, at the upstream and downstream groove edges, equal to that of flow duct wall and axially continuously linear therebetween. Accordingly, in a meridional section, the radial cutback is understood to be the free area between an airfoil-tip-side upper edge of the cross section of the web and a reference curve extending from the upstream groove edge to the downstream groove edge, the curvature of the reference curve being infinite or, at the upstream and downstream groove edges, equal to that of flow duct wall and axially continuously linear therebetween. In other words, in one embodiment, a "radial cutback" is understood to be the empty space or the free area between the airfoil-side end face or upper edge of the web and a virtual extension of the flow duct contour across the circumferential groove. This virtual extension of the contour may be a straight connecting plane or line or may connect the groove edges with a curvature that corresponds to the curvature of the flow duct contour at the groove edges and interpolates linearly therebetween.

In accordance with one aspect of the present invention, in particular in one or more meridional sections, preferably all meridional sections, through the airfoil-tip-side end face of the web, an upstream beginning of the cutback is located axially downstream of the upstream groove edge between this groove edge and the upstream leading edge of the airfoil tip, and a downstream end of the cutback is located in an airfoil-tip-proximal half of a radial height of the circumferential groove.

Surprisingly, it has been found that in one embodiment, in the case of an inventive cutback which begins downstream of the upstream groove edge and upstream of the upstream leading edge of the airfoil tip, and which ends in the airfoil-tip-proximal half of the circumferential groove, the advantages of the casing treatment during off-design operation are at least substantially retained, while at the same time making it possible to reduce unwanted flow phenomena during design operation; i.e., under nominal operating conditions.

In one embodiment, an "upstream beginning" of the cutback is understood to be the axial position beyond which the airfoil-side end face or upper edge of the web deviates from the virtual extension of the flow duct contour or the reference plane or curve in a direction away from the airfoil tip and toward the groove base. In another embodiment, an "upstream beginning" of the cutback is understood to be the axial position beyond which the airfoil-side end face or upper edge of the web deviates from the straight reference plane or curve in the radial direction toward the groove base by at least 1%, in particular at least 5%, of a maximum radial distance between the groove base and a groove edge that is closer to the airfoil tip.

In accordance with the preceding aspect, the upstream beginning of the cutback is located downstream of the upstream groove edge and upstream of the upstream leading edge of the airfoil tip. In one embodiment, the airfoil-side end face (or, in one or more meridional sections, preferably all meridional sections, through the airfoil-tip-side end face of the web, the upper edge) of the web continues the flow duct contour to the beginning of the cutback with a continuous curvature; i.e., without abrupt changes in the curvature.

Correspondingly, in one embodiment, a "downstream end" of the cutback is understood to be the axial position at which the airfoil-side end face or upper edge of the web merges back into the reference plane or curve or into the downstream groove flank. In another embodiment, a "downstream end" of the cutback is understood to be the axial position beyond which the airfoil-side end face or upper edge of the web once again deviates from the straight reference plane or curve in the radial direction toward the groove base by less than 5%, in particular less than 1%, of a maximum radial distance between the groove base and the groove edge that is closer to the airfoil tip.

In accordance with the preceding aspect, the downstream end of the cutback is located in an airfoil-tip-proximal half of a radial height of the circumferential groove. In the context of the present invention, a "radial height" of the circumferential groove is understood to be in particular a maximum distance between the groove base and the reference plane or curve; i.e., in particular, a maximum distance between the groove base and the groove edge that is closer to the airfoil tip, in the radial direction or a direction perpendicular to the connecting line between the upstream and downstream groove edges. Such a distance perpendicular to the connecting line may also be referred to in a generalized way as a radial height of the circumferential groove.

In one embodiment, the radial cutback ends in the reference plane or curve; in a refinement axially upstream or downstream of the upstream leading edge of the airfoil tip. In one embodiment, the airfoil-side end face (or, in one or more meridional sections, preferably all meridional sections, through the airfoil-tip-side end face of the web, the upper edge) of the web continues the flow duct contour in an upstream direction from the downstream groove edge to the end of the cutback with a continuous curvature; i.e., without abrupt changes in the curvature.

In another embodiment, the radial cutback ends in the radially upper half of the downstream groove flank, and the web is continuously cut back radially, starting at the beginning of the cutback. The term "radially upper half" is used in a generalized way to refer to the portion of the downstream groove flank that extends in the radial direction or a direction perpendicular to the connecting line between the upstream and downstream groove edges over 50% of the maximum distance of the downstream groove edge from the groove base in this direction.

In one embodiment, the web merges into the upstream flank and/or the downstream flank of the circumferential groove, and thus may in particular extend axially through the groove or the maximum axial length thereof. In this case, in one or more meridional sections, in particular all meridional sections, through the airfoil-tip-side end face of the web, as described earlier herein, an airfoil-tip-side upper edge of the web may, at the upstream groove edge, have the same curvature as the flow duct contour; i.e., at the upstream groove edge, it may have a continuous curvature and smoothly continue this curvature to the beginning of the cutback.

In a developed view, the web may be straight or curved; i.e., extend in a straight or curved manner. In particular, in one embodiment, the airfoil-side end face of the web may merge at least substantially axially with the upstream groove edge. In addition or alternatively, the airfoil-side end face may merge into the downstream groove flank with a curvature in or opposite to a direction of rotation of the airfoil tip.

Preferably, the area of the cutback in at least one meridional section is limited to no more than 30%, in particular no more than 25%, of the cross-sectional area of the circumferential groove. Accordingly, in one embodiment, in one or more meridional sections, in particular all meridional sections, through the airfoil-tip-side end face of the web, the web has a cross-sectional area which is at least 70%, in particular at least 75%, of the cross-sectional area of the circumferential groove in this meridional section.

According to the above definition, a cross-sectional area of the circumferential groove is the area which, in a meridional section, is defined by the groove base, the groove flanks and a straight connecting line between the upstream and downstream groove edges.

In one embodiment, in one or more meridional sections, in particular all meridional sections, through the airfoil-tip-side end face of the web, the circumferential groove forms an angle of between 60° and 90° with the flow duct wall at the upstream groove edge. This makes it possible in particular to produce an advantageous axial undercut.

In one embodiment, an axial distance between the upstream groove edge and the leading edge of the airfoil tip disposed downstream thereof is greater than an axial distance between the downstream groove edge and the leading edge of the airfoil tip disposed upstream thereof. In other words, the leading edge of the airfoil tip is located between the upstream and downstream groove edges and is closer to the downstream groove edge.

In one embodiment, an axial distance between the upstream and downstream groove edges is at least 25% of an axial distance between the upstream leading edge and a downstream trailing edge of the airfoil tip.

In a section perpendicular to an axis of rotation of the compressor, the web may be straight or curved. The web; i.e., its tangents, may extend radially or be inclined to the radial direction. Accordingly, in one embodiment, in one or more sections, in particular all sections, perpendicular to an axis of rotation of the compressor through the airfoil-tip-side end face of the web, the web is inclined toward the base of the circumferential groove in the direction of rotation of the airfoil tip, in particular by at least 25° and/or no more than 65° to the radial direction.

Further advantageous refinements of the present invention will be apparent from the dependent claims and the following description of preferred embodiments.

DETAILED DESCRIPTION

Figure 1:
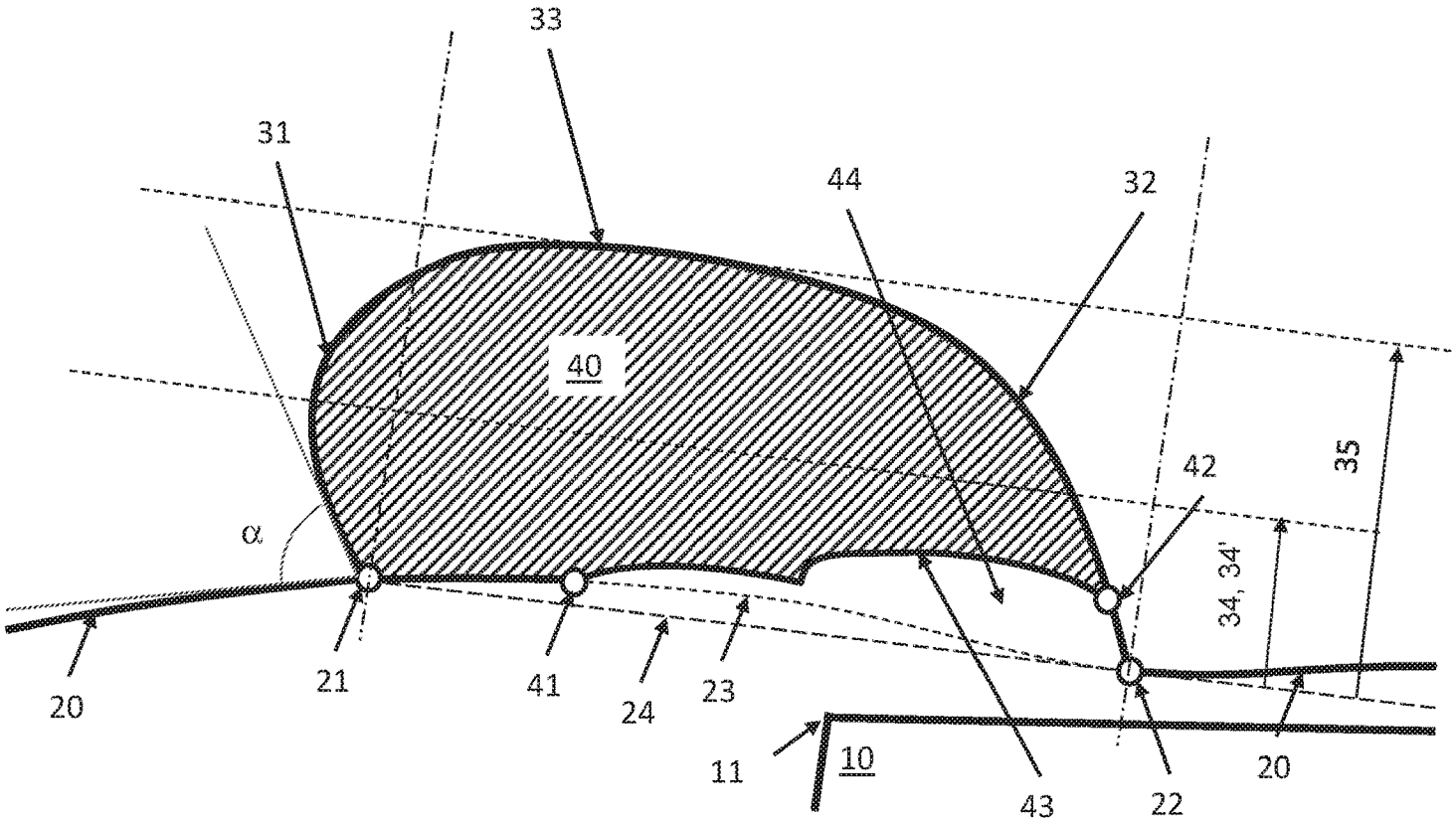
FIG. 1, shows, in partially schematic form, a portion of a gas turbine compressor in a meridional section.

To this end, the only drawing, FIG. 1, shows, in partially schematic form, a portion of a gas turbine compressor in accordance with one embodiment of the present invention in a meridional section.

FIG. 1 is a meridional cross section of a portion of a gas turbine compressor in accordance with one embodiment of the present invention; i.e., of a gas turbine compressor designed in accordance with one embodiment of the present invention. The meridional cross section contains the axis of rotation of the compressor (horizontal in FIG. 1). The vertical direction in FIG. 1 is a radial direction.

The gas turbine compressor includes rotor blades arranged adjacent one another in the circumferential direction (perpendicular to the plane of the drawing of FIG. 1) and having shroudless tips, and a flow duct wall 20 disposed radially opposite thereto, one blade tip 10 being partially shown in the meridional section of FIG. 1.

The flow duct wall has a circumferential groove formed therein, the circumferential groove having an upstream flank 31 which merges into the flow duct wall at an upstream groove edge 21, a downstream flank 32 which merges into the flow duct wall at a downstream groove edge 22, and a groove base 33 connecting these groove flanks.

The upstream groove flank has an axial undercut whose cross-sectional area in the meridional section is less than 10% of a cross-sectional area of the circumferential groove between its upstream and downstream groove edges. This cross-sectional area of the circumferential groove between its upstream and downstream groove edges is the area which, in the meridional section of FIG. 1, is defined by the groove base, a straight connecting line 24 between the upstream and downstream groove edges, and perpendicular lines through the upstream and downstream groove edges, which are indicated by dot-dash lines in FIG. 1. Accordingly, the cross-sectional area of the undercut is the area between upstream groove flank 31 and the dot-dash line perpendicular to connecting line 24 on the left in FIG. 1.

A plurality of webs are arranged in the circumferential groove and spaced apart in the circumferential direction (perpendicular to the plane of the drawing of FIG. 1), of which one web 40 is shown in cross-section in the meridional section of FIG. 1.

As explained earlier herein, reference numeral 24 denotes a straight connecting line 24 between upstream and downstream groove edges 21, 22. Thus, this line represents a reference curve which extends from the upstream groove edge to the downstream groove edge and whose curvature is infinite.

Reference numeral 23 in FIG. 1 denotes another reference curve which also extends from the upstream groove edge to the downstream groove edge, but whose curvature at the upstream and downstream groove edges is in each case equal to the curvature of the flow duct wall and axially continuously linear therebetween; i.e., linearly interpolates the curvature of flow duct wall 20 between groove edges 21, 22. Thus, this reference curve 23 represents a virtual extension of flow duct contour 20 across the circumferential groove.

In the meridional section of FIG. 1 through an airfoil-tip-side end face or upper edge 43 of web 40, reference curves 23, 24 each represent a corresponding circumferentially extending reference plane 23, 24.

As can be seen in the meridional section of FIG. 1, the airfoil-tip-side end face or upper edge 43 deviates from reference curve or plane 23; i.e., from the virtual extension of the flow duct contour, in a direction away from the airfoil tip and toward the groove base (upward in FIG. 1), starting at a point or circumferential line 41 up to another point or circumferential line 42.

Furthermore, starting at the point or circumferential line 41, the airfoil-side end face or upper edge 43 deviates from reference plane or curve 24 toward the groove base by at least 1% of a maximum radial distance between groove base 33 and groove edge 22 (i.e., the one closer to the airfoil tip).

Thus, the point or circumferential line 41 defines an upstream beginning of a radial cutback 44 of the web.

The airfoil-side end face or upper edge of the web continues flow duct contour 20 to this beginning 41 of cutback 44 with a continuous curvature. The point or circumferential line 42 defines a downstream end of radial cutback 44, where the airfoil-side end face or upper edge 43 of the web merges into downstream groove flank 32.

In a modification, the airfoil-side end face or upper edge 43 of the web merges back into reference plane or curve 23. In this case, the point or circumferential line where the airfoil-side end face or upper edge 43 of the web merges back into reference plane or curve 23, or the point or circumferential line beyond which the airfoil-side end face or upper edge of the web once again deviates from the straight reference plane or curve 24 toward groove base 33 by less than 1% of the maximum radial distance between groove base 33 and groove edge 22 (i.e., the one closer to the airfoil tip) represents the downstream end of the radial cutback.

In this modification, the airfoil-side end face or upper edge of the web may continue the flow duct contour with a continuous curvature from downstream groove edge 22 in an upstream direction (toward the left in FIG. 1) to this end of the cutback, as described and illustrated analogously for the region between upstream groove edge 21 and upstream beginning 41 of the cutback.

Thus, the empty space or the free area between the airfoil-side end face or upper edge 43 of the web and reference plane or curve 23 defines radial cutback 44 with its upstream beginning 41 and its downstream end 42.

As can be seen in the meridional section of FIG. 1, this upstream beginning 41 of cutback 44 is located axially downstream (to the right in FIG. 1) of upstream groove edge 21 between this groove edge 21 and upstream leading edge 11 of airfoil tip 10, and downstream end 42 of cutback 44 is located in an airfoil-tip-proximal half 34 of a radial height 35 of the circumferential groove.

The radial height may be defined as the maximum distance between groove base 33 and groove edge 22 (i.e., the one closer to the airfoil tip) in the radial direction (vertical in FIG. 1) or, as indicated in FIG. 1, the maximum distance 35 between groove base 33 and groove edge 22 (i.e., the one closer to the airfoil tip) in a direction perpendicular to the straight connecting line 24 between the upstream and downstream groove edges.

In the embodiment shown, the radial cutback ends in the radially upper half 34' of downstream groove flank 32, and the web is continuously cut back radially, starting at beginning 41. The term "radially upper half" is used to refer to the portion or region of downstream groove flank 32 that extends in the radial direction or a direction perpendicular to connecting line 24 between the upstream and downstream groove edges over 50% of the maximum distance of downstream groove edge 22 from groove base 33 in this direction.

In the embodiment of FIG. 1, web 40 merges into the upstream and downstream flanks 31, 32 of the circumferential groove, and thus extends axially through the groove.

As explained earlier herein, the airfoil-tip-side end face or upper edge of the web has, at upstream groove edge 21, the same curvature as flow duct contour 20 and smoothly continues this curvature to beginning 41 of cutback 44.

In the embodiment of FIG. 1, web 40 has a cross-sectional area (shown hatched in FIG. 1) which is at least 75% of the cross-sectional area of the circumferential groove in this meridional section, which is defined by groove flanks 31, 32, groove base 33, and connecting line 24 between the two groove edges 21, 22.

In the embodiment of FIG. 1, the circumferential groove forms an angle $\alpha$ of between 60° and 90° with flow duct wall 20 at upstream groove edge 21.

In the embodiment of FIG. 1, an axial distance between upstream groove edge 21 and leading edge 11 of airfoil tip 10 disposed downstream (to the right in FIG. 1) is greater than an axial distance between downstream groove edge 22 and leading edge 11 disposed upstream thereof.

In the embodiment of FIG. 1, an axial distance between upstream and downstream groove edges 21, 22 is at least 25% of an axial distance between upstream leading edge 11 and a downstream trailing edge (not shown) of airfoil tip 10.

Figure 2:
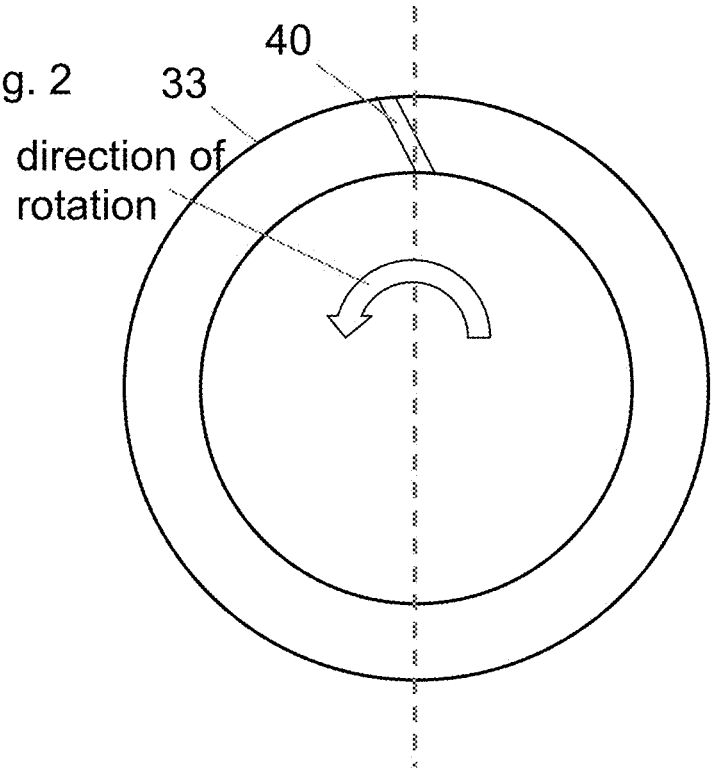
FIG. 2, shows, in schematic form, a web inclined toward a groove base of the circumferential groove in the direction of rotation of the airfoil tip.

As shown in FIG. 2, the web; i.e., its tangents, may extend radially or be inclined to the radial direction. Accordingly, in one embodiment, in one or more sections, in particular all sections, perpendicular (dashed line) to an axis of rotation of the compressor, the airfoil-tip-side end face of the web 40 is inclined toward the base 33 of the circumferential groove in the direction of rotation of the airfoil tip (arrow), in particular by at least 25° and/or no more than 65° to the radial direction.

Although the above is a description of exemplary embodiments, it should be noted that many modifications are possible. It should also be appreciated that the exemplary embodiments are only examples, and are not intended to limit the scope, applicability, or configuration in any way. Rather, the foregoing detailed description provides those skilled in the art with a convenient road map for implementing at least one exemplary embodiment, it being understood that various changes may be made in the function and arrangement of elements described without departing from the scope of protection set forth in the appended claims and their equivalent combinations of features.

LIST OF REFERENCE NUMERALS

10 airfoil tip
11 leading edge
20 flow duct contour
21 upstream groove edge
22 downstream groove edge
23 reference plane/curve
24 straight reference plane/curve
31 upstream groove flank
32 downstream groove flank
33 groove base
34 airfoil-tip-proximal half of the circumferential groove
35 radial height of the circumferential groove
40 web
41 upstream beginning of the cutback
42 downstream end of the cutback
43 airfoil-tip-side end face/upper edge
44 cutback
$\alpha$ angle

What is claimed is:

1. A gas turbine compressor comprising:
at least one airfoil tip;
a flow duct wall disposed radially opposite thereto and having a circumferential groove therein;
at least one web disposed in the circumferential groove and having a radial cutback;
an upstream beginning of the cutback being located axially downstream of an upstream groove edge between this groove edge and an upstream leading edge of the airfoil tip, and a downstream end of the cutback being located at the circumferential groove in an airfoil-tip-proximal half of a radial height of the circumferential groove;
wherein the web merges into an upstream groove flank and a downstream groove flank of the circumferential groove, wherein, in at least one meridional section, the web has a cross-sectional area which is at least 70% of a cross-sectional area of the circumferential groove.

2. The gas turbine compressor as recited in claim 1 wherein, in the at least one meridional section, an airfoil-tip-side upper edge of the web has a continuous curvature at the upstream groove edge.

3. The gas turbine compressor as recited in claim 1 wherein, in the at least one meridional section, an airfoil-tip-side upper edge of the web has a continuous curvature at the upstream groove edge up to the beginning of the cutback.

4. The gas turbine compressor as recited in claim 1 wherein an airfoil-side end face of the web merges at least substantially axially with the upstream groove edge or merges into the downstream groove flank with a curvature in or opposite to a direction of rotation of the airfoil tip.

5. The gas turbine compressor as recited in claim 1 wherein, in the at least one meridional section, the cross-sectional area is at least 75%, of the cross-sectional area of the circumferential groove.

6. The gas turbine compressor as recited in claim 1 wherein the circumferential groove extends through a full circumference of the flow duct wall.

7. The gas turbine compressor as recited in claim 1 wherein, in the at least one meridional section, the circumferential groove forms an angle (a) of between 60° and 90° with the flow duct wall at the upstream groove edge.

8. The gas turbine compressor as recited in claim 1 wherein an axial distance between the upstream groove edge and the leading edge of the airfoil tip disposed downstream thereof is greater than an axial distance between the downstream groove edge and the leading edge of the airfoil tip disposed upstream thereof.

9. The gas turbine compressor as recited in claim 1 wherein an axial distance between the upstream and downstream groove edges is at least 25% of an axial distance between the upstream leading edge and a downstream trailing edge of the airfoil tip.

10. The gas turbine compressor as recited in claim 1 wherein in at least one section perpendicular to an axis of rotation of the compressor, the web is inclined toward a groove base of the circumferential groove in a direction of rotation of the airfoil tip.

11. The gas turbine compressor as recited in claim 1 wherein in at least one section perpendicular to an axis of rotation of the compressor, the web is inclined toward a groove base of the circumferential groove in a direction of rotation of the airfoil tip by at least 25° or no more than 65° to a radial direction.

12. The gas turbine compressor as recited in claim 1 wherein at least three identical or different webs are arranged in the circumferential groove and spaced equidistantly or at varying intervals apart in the circumferential direction.

13. The gas turbine compressor as recited in claim 1 wherein the airfoil tip is a radially outer tip of a rotor blade, and the flow duct wall is located radially outwardly thereof and opposite thereto.

14. The gas turbine compressor as recited in claim 1 wherein the airfoil tip is a radially inner tip of a stator vane, and the flow duct wall is located radially inwardly thereof and opposite thereto.

15. The gas turbine compressor as recited in claim 1 wherein the upstream groove flank or the downstream groove flank of the circumferential groove has an axial undercut whose cross-sectional area in the at least one meridional section is less than 10% of a cross-sectional area of the circumferential groove between its upstream and downstream groove edges.

16. An aircraft engine comprising the gas turbine compressor as recited in claim 1.

17. The gas turbine compressor of claim 1, wherein the downstream end of the cutback is located at the downstream groove flank of the circumferential groove.

18. A method for designing a gas turbine compressor as recited in claim 1 comprising the steps of:

locating the upstream beginning of the cutback axially downstream of the upstream groove edge between the upstream groove edge and the upstream leading edge of the airfoil tip, and locating the downstream end of the cutback in the airfoil-tip-proximal half of the radial height of the circumferential groove.

19. A gas turbine compressor comprising:

at least one airfoil tip;

a flow duct wall disposed radially opposite thereto and having a circumferential groove therein;

at least one web disposed in the circumferential groove and having a radial cutback;

an upstream beginning of the cutback being located axially downstream of an upstream groove edge between this groove edge and an upstream leading edge of the airfoil tip, and a downstream end of the cutback being located at the circumferential groove in an airfoil-tip-proximal half of a radial height of the circumferential groove;

wherein, in at least one meridional section, the web has a cross-sectional area which is at least 75% of a cross-sectional area of the circumferential groove; and wherein the web merges into a downstream groove flank of the circumferential groove.

20. A gas turbine compressor comprising:

at least one airfoil tip;

a flow duct wall disposed radially opposite thereto and having a circumferential groove therein;

at least one web disposed in the circumferential groove and having a radial cutback;

an upstream beginning of the cutback being located axially downstream of an upstream groove edge between this groove edge and an upstream leading edge of the airfoil tip, and a downstream end of the cutback being located at the circumferential groove in an airfoil-tip-proximal half of a radial height of the circumferential groove;

wherein the web merges into a downstream groove flank of the circumferential groove, wherein, in at least one meridional section, the web has a cross-sectional area which is at least 70% of a cross-sectional area of the circumferential groove.

* * * * *